United States Patent [19]

Hunt

[11] Patent Number: 4,650,113

[45] Date of Patent: Mar. 17, 1987

[54] MAILBOX

[76] Inventor: Patrick T. Hunt, R.R. 1, Box 146, Smithville, Mo. 64089

[21] Appl. No.: 790,393

[22] Filed: Oct. 23, 1985

[51] Int. Cl.[4] ..... B65D 91/00

[52] U.S. Cl. ..... 232/17; 232/30; 232/43.4

[58] Field of Search ..... 232/17, 20, 24, 27, 232/28, 29, 30, 38, 43

[56] References Cited

U.S. PATENT DOCUMENTS

| | | | |
|---|---|---|---|
| 167,928 | 9/1875 | Coward | 254/342 |
| 185,790 | 12/1876 | Kubato | 131/300 |
| 210,332 | 11/1878 | Favaro | 105/93 |
| 249,970 | 11/1881 | Wetzel | 521/41 |
| 265,264 | 10/1882 | Yeh | 139/297 |
| 736,815 | 8/1903 | Brown | 232/17 |
| 838,194 | 12/1906 | Larsh | 232/17 |
| 908,543 | 1/1909 | Brown | 232/17 |
| 2,156,858 | 5/1939 | Landis | 232/17 |
| 2,561,007 | 7/1951 | Bierig | 232/17 |
| 3,106,335 | 10/1963 | Allan | 232/17 |
| 3,680,773 | 8/1972 | Thompson | 232/17 |
| 3,942,715 | 3/1976 | Anderson | 232/17 |
| 4,220,278 | 9/1980 | Hasselbring | 232/35 |
| 4,508,259 | 4/1985 | Hicks | 232/17 |

FOREIGN PATENT DOCUMENTS

| | | | |
|---|---|---|---|
| 2022502 | 11/1971 | Fed. Rep. of Germany | 232/17 |

*Primary Examiner*—Gene Mancene
*Assistant Examiner*—John G. Weiss
*Attorney, Agent, or Firm*—Kokjer, Kircher, Bradley, Wharton, Bowman & Johnson

[57] ABSTRACT

A mailbox has the usual hinged door on the roadside end and a special hinged cover which normally closes a back access opening through which mail may be removed. The back access opening extends through the top, back end and both sides of the mailbox to facilitate access to the mail when the cover is open. The cover includes transparent panels on its back end and top so that the contents of the mailbox are visible from the end which faces the house but are not visible to passersby from the roadside end. The mail is received on a tilting floor panel which assumes an inclined orientation when the door is closed to make the mailbox contents visible from a considerable distance. The floor panel is transparent so that pieces of mail which may become lodged beneath it are visible.

17 Claims, 4 Drawing Figures

4.
4.
10
12
14
16
18
22
24
26
28
30
32
34
36
38
40
42
44
46
48
50
52
54
58
60
62
63
64
65
68

MAILBOX

BACKGROUND OF THE INVENTION

This invention relates in general to mailboxes and deals more particularly with a mailbox which is constructed to permit mail recipients to visually detect the presence of mail from a distance. The mailbox of the present invention also provides easier access to mail which is deposited in the box.

Roadside mailboxes typically include a single door which faces the roadway and is used both to deposit mail and to remove mail from the box. The mailbox is often located a considerable distance from the house, and it is necessary for the recipient to walk out to the mailbox and check to determine whether the mail has arrived. Although many mailboxes are equipped with signal flags, they are not used consistently and do not detract appreciably from the number of trips that must be made to and from the mailbox.

Mailboxes that are wholly or partially transparent have been proposed so that the contents of the box are visible from a considerable distance. However, if a single envelope or several envelopes or other flat pieces of mail are present in the mailbox, they are difficult to see from a distance because of their horizontal position on the floor of the mailbox. Another drawback associated with transparent mailboxes is that persons passing by on the road can see that mail is present and possibly tamper with it.

The retrieval of mail from conventional mailboxes is especially difficult for the elderly. It is necessary to walk around to the roadside of the mailbox and open the door, to stoop down to see if any mail is present, and to reach into the mailbox to remove the mail. The need to stand on the roadside of the mailbox can be dangerous, and the need to stoop down and reach into the box is especially difficult for elderly persons. Mailboxes having doors on both ends have been proposed so that the mail can be deposited from the road side of the mailbox and removed from the house side. However, the house side access opening is located in the end of the box, and it is still necessary for the recipient to stoop down to check for the presence of mail and to reach into the end of the mailbox to remove it. In addition, if the mail carrier is careless in depositing the mail in the box, it can slide through the box and fall completely or partially out through the back or house side door.

SUMMARY OF THE INVENTION

The present invention is directed to a mailbox which is specially constructed and arranged such that mail that is present in the box is displayed to the recipient but not to passers-by. The construction of the mailbox also makes access to the mail more convenient than is the case with conventional mailboxes.

It is an important object of the invention to provide a mailbox in which it is possible to determine from a distance whether or not mail is present in the box. This is accomplished by using a tilting floor panel which receives the mail and which is maintained at an inclined orientation in order to conspicuously display even a single flat envelope present in the mailbox.

An important related feature of the invention is the provision of a transparent panel on the end of the mailbox which faces the house and another transparent panel on the top of the mailbox adjacent the end which faces the house. The transparent panels permit any mail which is present in the mailbox to be clearly visible from the house or yard of the recipient. At the same time, persons passing by on the road are not able to view the contents of the mailbox.

Another object of the invention is to provide a mailbox in which the floor panel is horizontal when the front or road side door is open. Consequently, the mail carrier can deposit mail in the box in the usual manner on top of the panel. When the door is thereafter closed, the tilting panel automatically assumes an inclined orientation to make the mail visible from the house side of the mailbox at a considerable distance.

A further object of the invention is to provide a mailbox wherein the tilting floor panel is transparent so that any pieces of mail that may inadvertently become lodged beneath it are readily visible.

Yet another object of the invention is to provide a mailbox having a back access opening which extends through the top and sides of the mailbox adjacent the end which faces the house. This makes access to the mail more convenient, particularly for the elderly, because the contents of the mailbox can be both viewed and reached from the top without the need to stoop. The mail can also be reached through the back access opening from either side of the mailbox to make access to the mail even more convenient, particularly if adjacent shrubbery or support posts make rear retrieval of the mail difficult.

An additional object of the invention is to provide a mailbox having a cover for the back access opening which can be quickly and easily opened and closed.

A still further object of the invention is to provide a mailbox of the character described which is constructed to prevent mail deposited through the front opening from falling out through the back opening. The back opening has an upstanding barrier which projects upwardly well above the floor panel to intercept the mail so that it is unable to fall out through the mailbox.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
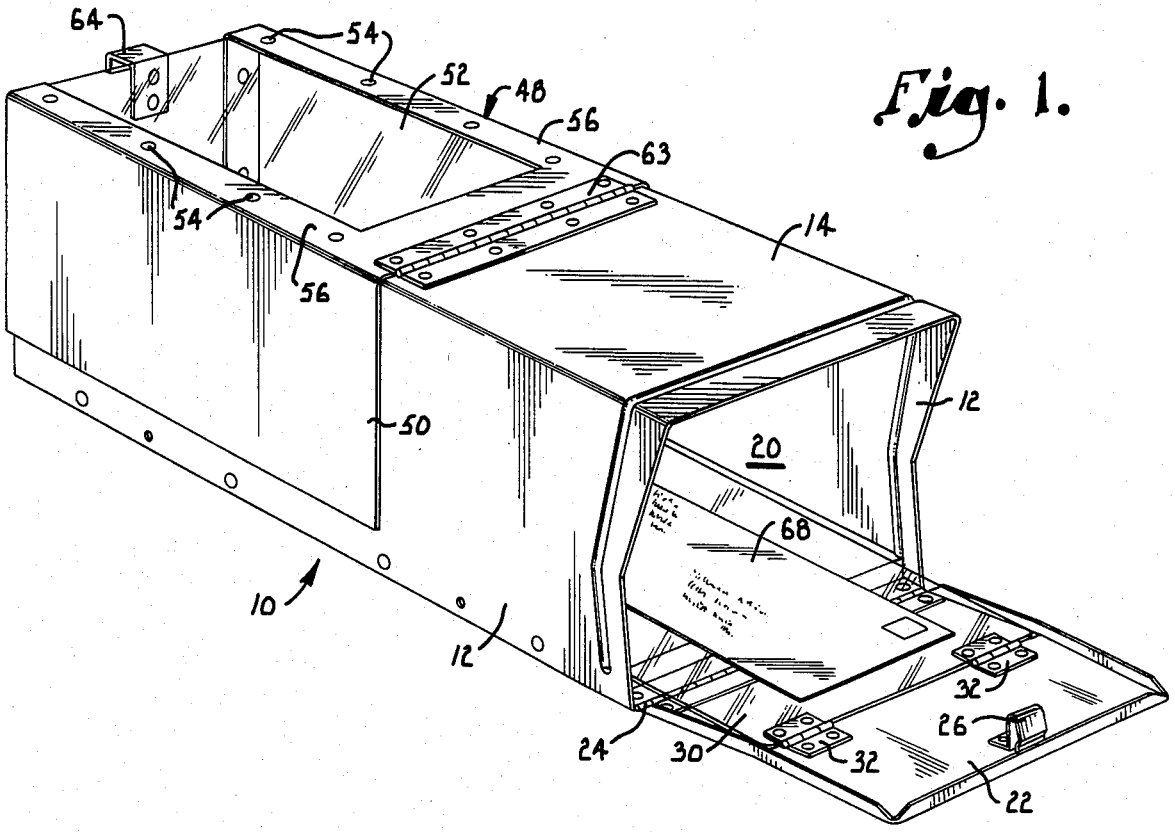
FIG. 1 is a perspective view of a mailbox constructed according to a preferred embodiment of the present invention, taken from one side of the mailbox and showing the front door in an open position with an envelope deposited on the tilting floor of the mailbox.
Figures 3, 4:
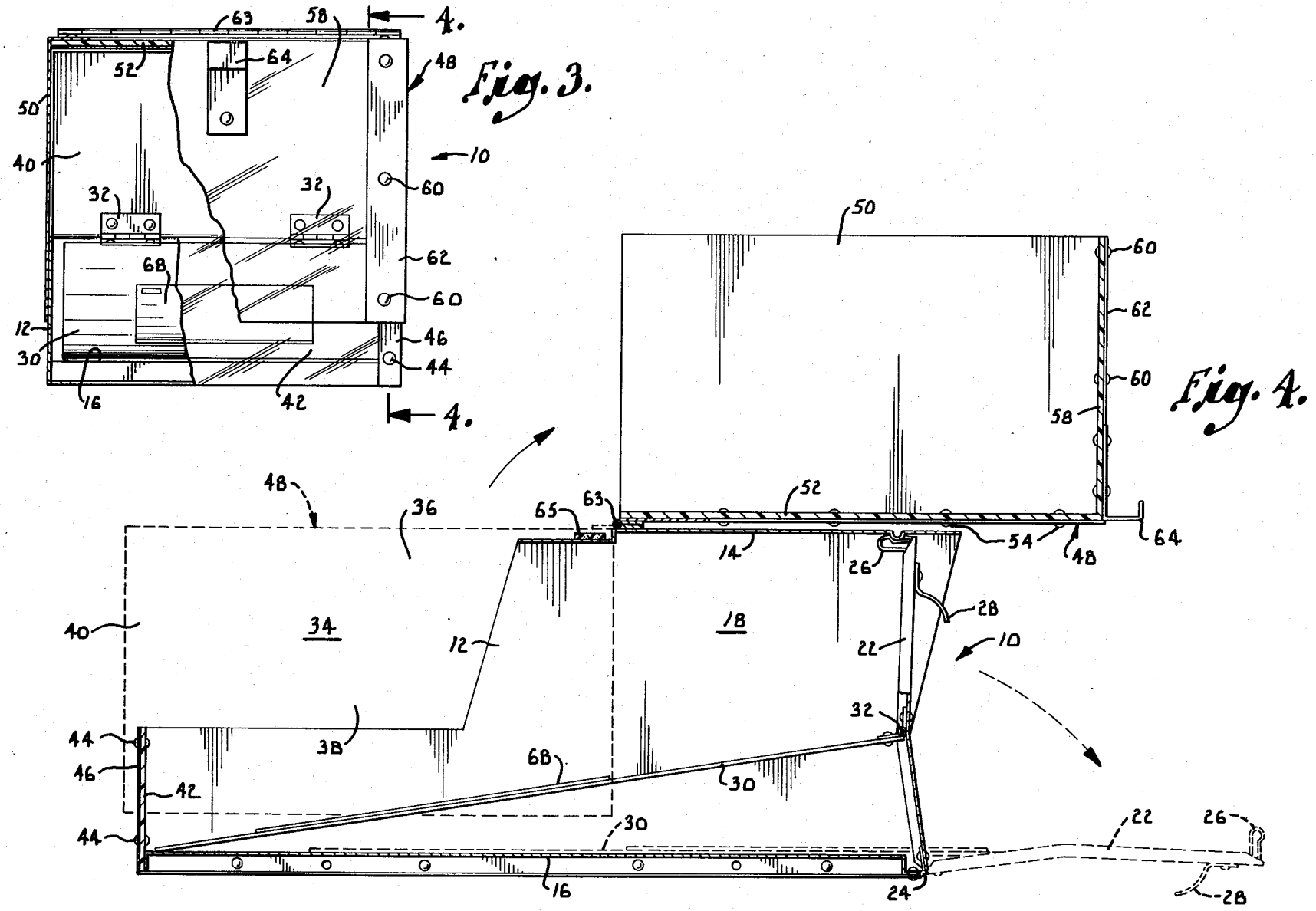
FIG. 3 is an end elevational view of the mailbox taken from the end which faces the house, with the back cover closed and portions broken away for illustrative purposes.
FIG. 4 is a sectional view taken generally along line 4—4 of FIG. 1 in the direction of the arrows, with the broken lines illustrating the open position of the front door and the closed position of the back cover.

Referring now to the drawings in more detail, numeral 10 generally designates a mailbox constructed in accordance with the present invention. The mailbox 10 is a rectangular, box-like container having a pair of opposite side walls 12, a top panel 14 and a bottom panel 16 which cooperate to provide a generally rectangular compartment 18 (FIG. 2) for receiving and holding mail. One or both side walls 12 can include a transparent panel which displays on a card the name and/or address of the house occupant. The end of the mailbox 10 which faces the road is open to provide a front access opening 20 (FIG. 1) through which the mail carrier can deposit mail. The front access opening 20 is normally closed by a hinged door 22 which is connected with the bottom of the mailbox by a piano type hinge 24. Door 22 can be pivoted about the horizontal axis provided by hinge 24 between the open position shown in FIG. 1 and in broken lines in FIG. 4 and the closed position shown in solid lines in FIG. 4. In the open position, door 22 is generally horizontal to expose the opening 20. In the closed position, door 22 is vertical to close opening 20. A catch 26 on the inside surface of door 22 holds the door closed. The outside surface of door 22 is provided with a handle 28 which facilitates opening and closing of the door. Walls 12, panels 14 and 16 and the door 22 may be constructed from sheet metal or another suitable material.

In accordance with the present invention, the mail which is deposited in the mailbox 10 is received and held on a flat rectangular floor panel 30 which is slightly smaller than the bottom panel 16 of the mailbox. The front edge of panel 30 is connected with the inside surface of door 22 by a pair of hinges 32 which cooperate to provide a horizontal hinge axis about which panel 30 can pivot relative to door 22. The hinges 32 are offset from hinge 24 and are located well above hinge 24 when door 22 is in the closed position shown in solid lines in FIG. 4. When door 22 is in its open position, panel 30 has a generally horizontal orientation and lies on the floor panel 16 in a position to receive the mail deposited into the mailbox through the front opening 20. When door 22 is raised from the open position toward the closed position, hinges 32 are gradually raised to elevate the front edge of panel 30. The back edge of panel 30 remains on bottom panel 16 at all times and is thus disposed well below the front edge of panel 30 when door 22 is closed. In the fully closed position of door 22, panel 30 has an inclined orientation and angles downwardly from its front edge toward its rear edge. Panel 30 is transparent so that any small pieces of mail which may become accidentally lodged between panels 16 and 30 will be visible through the transparent panel 30.

The mailbox 10 has a back access opening 34 through which the mail can be removed from the mailbox. Opening 34 extends through the top panel 14 as indicated at 36 in FIG. 4, through both side walls 12 as indicated at 38 in FIG. 4, and through the end of the mailbox opposite the front access opening 20 as indicated at 40 in FIG. 4. Consequently, the contents of compartment 18 are accessible from the top through opening 36, from either side of the mailbox through openings 38, and from the back or house facing side of the mailbox through opening 40. Opening 36 extends through the top panel 14 on the portion thereof adjacent opening 40, while the side openings 38 are likewise located adjacent to opening 40. Below the side openings 38, the side walls of the mailbox project well above the bottom panel 16.

Figure 2:
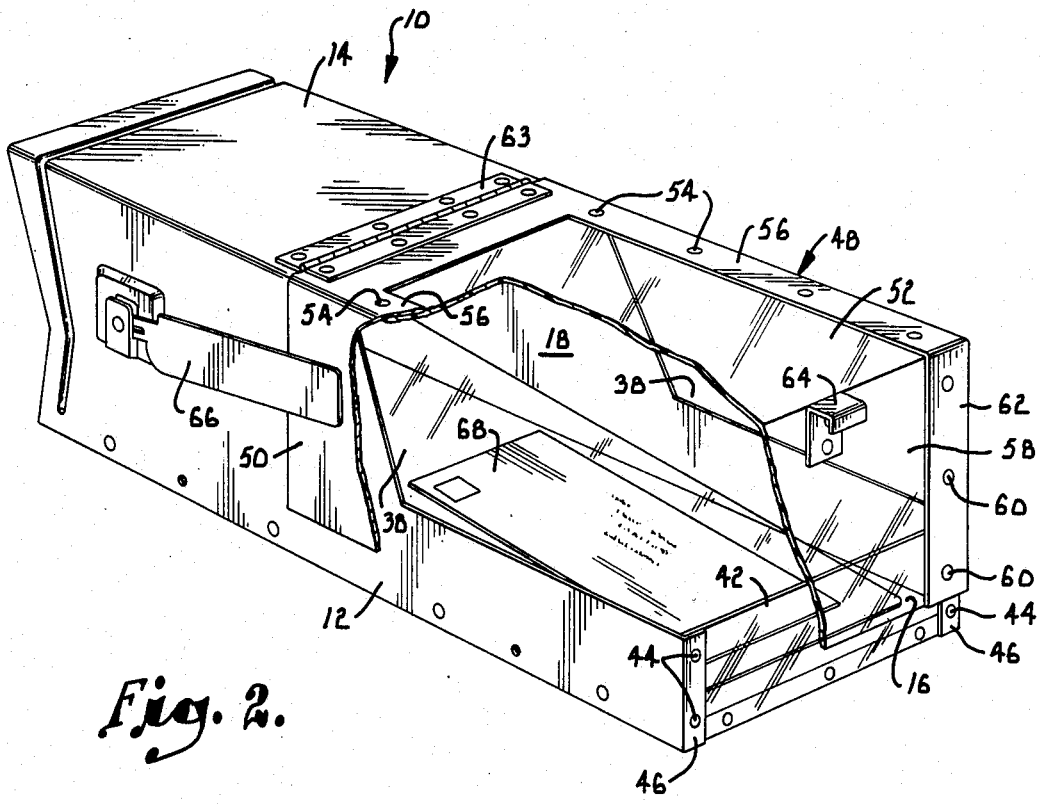
FIG. 2 is a perspective view of the mailbox taken from the side opposite that shown in FIG. 1, with the front door in the closed position and a portion of the back cover broken away for illustrative purposes.

Below the end opening 40, an end barrier 42 extends upwardly well above the bottom panel 16 and the back edge of panel 30. As shown in FIG. 2, the barrier 42 is secured by rivets 44 or other fasteners to flanges 46 which are turned inwardly from the back edges of the side walls 12. The barrier 42 is preferably transparent.

The back access opening 34 is normally closed by a cover which is generally designated by numeral 48. The cover 48 includes parallel opposite sides 50 which cover the side openings 38 when the cover is closed. The top of cover 48 includes a transparent panel 52 which is secured by rivets 54 to flanges 56 which are turned inwardly from the upper edges of the side 50. The top panel 52 covers the top opening 36 when cover 48 is closed. The back of cover 48 includes a transparent end panel 58 which is secured by rivets 60 to flanges 62 which are turned inwardly from the back edges of the sides 50. Panel 58 overlaps barrier 42 to cover the back opening 40 when cover 48 is closed. The components of the mailbox are opaque except for panels 30, 52 and 58 and barrier 42.

Cover 48 is connected to the top panel 14 of the mailbox for opening and closing movement about the horizontal axis established by a hinge 63. In the open position of cover 48 shown in solid lines in FIG. 4, the entirety of the back access opening 34 is exposed, and panel 52 lies on panel 14. In the closed position of cover 48, opening 34 is closed by the cover. A handle 64 is provided on panel 58 to facilitate opening and closing of the cover. A gasket 65 (see FIG. 4) seals against cover 48 in its closed position. If desired, the hinge 63 may be spring loaded in the manner of the trunk lid of an automobile so that the cover can be lifted slightly and will then spring open and remain open. This permits one hand only to be used to open the cover, retrieve the mail and then close the cover.

One of the side walls 12 may be provided with a signal flag 66. The signal flag 66 may be pivoted between the horizontal position shown in FIG. 2 and a vertical position in which the signal flag indicates the presence of mail within the mailbox 10.

In use of the mailbox 10, the mail carrier opens door 22 and deposits mail into the mailbox through the front access opening 20. Mail such as the envelope 68 is received on panel 30 which is in its horizontal mail receiving position when door 22 is open. When the mail carrier has completed depositing the mail into the compartment 18, he closes door 22, and panel 30 then assumes the inclined mail displaying position shown in solid lines in FIG. 4.

Because of the incline of panel 30, the mail which is present within compartment 18 is visible through the transparent panels 52 and 58 from a considerable distance. Thus, the mail recipient can see from his house or yard whether or not mail is present in the mailbox. However, persons passing by on the road are able to see only the opaque front portions of the mailbox and are not able to view the contents through the panels 52 and 58 located on the back portion of the mailbox. In this manner, the mailbox conspicuously displays mail to the recipient from a considerable distance while shielding it from passers-by.

Mail is normally removed from the mailbox through the back opening 34, although it can also be removed through the front opening 20 if desired. In order to gain access to the mail through the back opening 34, cover 48 is raised to its open position, and the mail can be reached through the back opening 34. It is noted that there is no need to stoop because the mail can be viewed through the top panel 52, and it can likewise be reached through the top opening 36. Consequently, access to the mail is relatively easy even for elderly persons who have difficulty in stooping. The mail can also be removed from either side of the mailbox, by reaching through either of the side openings 38, and it can also be removed by reaching through the back opening 40. After the mail has been removed from compartment 18, the cover 48 is swung downwardly to the closed position.

The barrier 42 projects well above the bottom panel 16 to prevent mail from inadvertently passing out through the back opening 40. In addition, because the cover 48 must be swung upwardly to its open position, the cover assists in preventing mail from falling out through the back of the mailbox. The barrier 42 is preferably transparent so that it cooperates with panel 58 to permit viewing of the contents of the mailbox from a distance.

It should be understood that the back opening 34 can have configurations other than the configuration shown in the drawings, and that the cover 48 can also vary in its configuration. The cover can also be mounted to slide between its open and closed positions rather than being hinged. A sliding drawer-type structure can also be used.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. In a mailbox having a box member with opposite first and second end portions and a door on said first end portion movable between open and closed positions to open and close the box member, the improvement comprising:

a panel in said box member mounted therein for movement between a mail receiving position when the door is in the open position and a mail display position when the door is in the closed position, said panel having an orientation in the mail receiving position to receive mail deposited in the box member and being inclined downwardly from said first end portion toward said second end portion in the display position to maintain mail thereon at an incline;

a transparent member on said second end portion of the box member through which mail on said panel in the display position thereof is visible; and means for maintaining said panel in the display position to display mail thereon when said door is in the closed position.

2. The improvement of claim 1, wherein said box member includes a horizontal floor, said panel being disposed on said floor in a substantially horizontal orientation in the mail receiving position of the panel.

3. The improvement of claim 2, wherein said panel is at least partially transparent to permit viewing of mail disposed between said panel and floor.

4. The improvement of claim 1, including:

a generally horizontal pivot axis about which said door is movable between the open and closed positions; and hinge means for coupling said panel with said door for pivotal movement relative thereto about a hinge axis offset from said pivot axis, said hinge axis being located above said pivot axis in the closed position of the door to effect movement of the panel to the display position upon movement of the door to the closed position.

5. The improvement of claim 1, including means for coupling said panel with said door in a manner to effect movement of the panel to the mail receiving position upon movement of the door to the open position, and to effect movement of the panel to the display position upon movement of the door to the closed position.

6. The improvement of claim 1, including:

a back portion of said box member presenting an access opening in said second end portion; and a closure for said access opening mounted on the box member for movement between an open position wherein mail on said panel is accessible through said access opening and a closed position wherein said access opening is covered by the closure.

7. The improvement of claim 6, including:

a floor of said box member on which said panel is disposed in the mail receiving position; and a barrier projecting generally upwardly from said floor to prevent mail deposited on said panel from sliding off of said panel and through said access opening.

8. The improvement of claim 1, including:

opposite side walls of the box member and a top panel thereof;

an access opening through said top panel at a location adjacent said second end portion; and a cover for said access opening mounted on the box member for movement between an open position in which said access opening is exposed to provide access to the contents of the box member and a closed position in which said access opening is closed by the cover.

9. The improvement of claim 1, including:

opposite side walls of the box member and a top panel thereof;

an access opening extending through said top panel, each of said side walls and said second end portion of the box member;

a cover mounted on said box member for movement between an open position wherein the contents of the box member are accessible through said access opening from the top, either side and said second end portion, and a closed position wherein the access opening is closed by the cover, said cover having a top portion covering the top of the access opening in the closed position and opposite sides covering the sides of the access opening in the closed position; and said transparent member being part of said cover and closing said second end portion of the box member in the closed position of the cover.

10. The improvement of claim 9, wherein said top portion of the cover is at least partially transparent and said opposite sides of the cover are opaque.

11. A mailbox comprising:

a box member having a floor and opposite ends, one of said ends having an access opening for receiving mail deposited in the box member and the other of said ends being at least partially transparent;

a door mounted on said one end of the box member for movement about a generally horizontal pivot axis between open and closed positions to respectively expose and close said access opening;

a panel for receiving mail deposited in said box member, said panel having a front edge portion and a rear edge portion disposed on said floor; and a hinge coupling said front edge portion of the panel with the door in a manner to effect pivotal movement of the panel relative to the door about a hinge axis offset from said pivot axis between a mail receiving position when said door is moved to the open position and a mail display position when said door is moved to the closed position, said panel being disposed in the mail receiving position at an orientation to receive mail inserted through said access opening and being inclined downwardly from said one end toward said other end in the display position to display the presence of mail thereon through said other end of the box member, said hinge axis having a location on the door to effect raising of said front edge portion of the panel in response to movement of the door toward the closed position.

12. A mailbox as set forth in claim 11, wherein said box member has a top which is transparent on a portion thereof located adjacent said other end of the box member.

13. A mailbox as set forth in claim 11, including:

a top of the box member;

a second access opening extending through said top of the box member at a location adjacent said other end and spaced from said one end; and a cover for said second access opening mounted on said box member for movement between an open position in which the contents of the box member are accessible through said second access opening and a closed position in which said second access opening is closed by the cover.

14. A mailbox as set forth in claim 13, wherein said cover is at least partially transparent.

15. A mailbox comprising:

a box member having opposite first and second ends, a pair of opaque opposite side walls and opaque top and bottom portions cooperating to present a compartment within the box member for receiving and holding mail, said box member having an opaque door thereon movable between open and closed positions to respectively open and close said first end;

an access opening extending through said second end of the box member and through the top portion of said box member at a location adjacent said second end and spaced from said first end; and a cover for said access opening mounted on the box member for movement between an open position wherein said access opening is exposed to provide access therethrough to mail in said compartment, and a closed position wherein said access opening is covered by the cover, said cover having a top panel and an end panel which are each at least partially transparent to permit the contents of the box member to be viewed from said second end but not from said first end or from either side.

16. In a mailbox having a box member with opposite first and second end portion and a door on said first end portion movable about a generally horizontal pivot axis between open and closed positions to open and close the box member, the improvement comprising:

a panel in said box member for receiving mail deposited therein;

hinge means for coupling said panel with said door for pivotal movement relative thereto about a hinge axis offset from said pivotal axis between a mail receiving position when the door is in the open position and a mail display position when the door is in the closed position, said panel having an orientation in the mail receiving position to receive mail deposited in the box member and being inclined downwardly from said first end portion toward said second end portion in the display position to maintain mail thereon at an incline, said hinge axis being located above said pivot axis in the closed position of the door to effect movement of the panel to the display position upon movement of the door to the closed position; and a transparent member on said second end portion of the box member through which mail on said panel in the display position thereof is visible.

17. In a mailbox having a box member with opposite first and second end portions and a door on said first end portion movable between open and closed positions to open and close the box member, the improvement comprising:

a panel in said box member mounted therein for movement between a mail receiving position when the door is in the open position and a mail display position when the door is in the closed position, said panel having an orientation in the mail receiving position to receive mail deposited in the box member and being inclined downwardly from said first end portion toward said second end portion in the display position to maintain mail thereon at an incline;

a transparent member on said second end portion of the box member through which mail on said panel in the display position thereof is visible;

a back portion of said box member presenting an access opening in said second end portion;

a closure for said access opening mounted on the box member for movement between an open position wherein mail on said panel is accessible through said access opening and a closed position wherein said access opening is covered by the closure;

a floor of said box member on which said panel is disposed in the mail receiving position; and a barrier projecting generally upwardly from said floor to prevent mail deposited on said panel from sliding off of said panel and through said access opening.

* * * * *